US005393284A

United States Patent [19]

Wesley

[11] Patent Number: 5,393,284

[45] Date of Patent: Feb. 28, 1995

[54] FLEXIBLE BARBELL EXERCISE APPARATUS

[76] Inventor: Jerry L. Wesley, 15020 "E" Avenida Montuosa, San Diego, Calif. 92129

[21] Appl. No.: 174,779

[22] Filed: Dec. 29, 1993

[51] Int. Cl.[6] ..... A63B 11/00

[52] U.S. Cl. ..... 482/106; 482/108

[58] Field of Search ..... 482/104–109, 482/82, 148, 93, 124, 126; 128/DIG. 15; D21/191, 196

[56] References Cited

U.S. PATENT DOCUMENTS

| | | | |
|---|---|---|---|
| D. 307,454 | 4/1990 | Driscoll | D21/196 |
| D. 336,497 | 6/1993 | Carballo | D21/191 |
| 1,918,142 | 7/1933 | Smith | 482/108 |
| 3,231,270 | 1/1966 | Winer | 482/106 |
| 4,505,474 | 3/1985 | Mattox | 482/82 |
| 4,695,051 | 9/1987 | Jenison | 482/108 |
| 4,854,576 | 8/1989 | McWain | 482/108 |
| 4,921,246 | 5/1990 | Hornbostel | 482/106 |
| 5,090,693 | 2/1992 | Liang | 482/108 |
| 5,300,001 | 4/1994 | Sealy | 482/108 |

*Primary Examiner*—Stephen Crow
*Assistant Examiner*—Jerome Donnelly
*Attorney, Agent, or Firm*—Baker, Maxham, Jester & Meador

[57] ABSTRACT

A flexible barbell exercise apparatus which may be reconfigured to become rigid. Weight receiving vessels disposed at either end of a flexible tube may be filled with a weight bearing material in order to provide exercise weight resistance to a user. The weight receiving vessels may receive various types of weight bearing material, including sand. A rigid bar may be placed inside of a central bore of a flexible tube to stiffen the apparatus. In a rigid state, the apparatus may be used for conventional weight training exercises, such as bench or military press type exercises. The rigid bar may be removed to return the apparatus to a flexible state. In a flexible state, the apparatus may be used for aerobic conditioning, such as a bicycle peddling type exercise. The weights may be removed, and the tube folded in order to facilitate easy transportation and storage of the apparatus.

17 Claims, 2 Drawing Sheets

FLEXIBLE BARBELL EXERCISE APPARATUS

BACKGROUND OF THE INVENTION

The present invention is related generally to exercise apparatus, and more particularly, to a barbell having flexible properties, but being reconfigurable to become rigid.

It is generally agreed that exercise is an important part of staying healthy. Many exercise enthusiasts recommend an exercise program which includes weight training and aerobic conditioning. Such a program should be carried out three to four times a week to be effective. The advantage of weight training is that it increases physical strength, and it firms and tones the muscles. Further, weight training increases the percentage of muscle over the percentage of fat in the body. Such a physique is said to be "lean". Being lean improves the body's ability to burn carbohydrates as energy, otherwise the carbohydrates would be converted to unhealthy body fat. Aerobic conditioning, on the other hand, generally increases the efficiency and capacity of the cardiovascular system by improving the heart's ability to maintain blood circulation in the body. Thus, an effective exercise program strengthens the body's muscles, reduces body fat, and strengthens the heart.

It is apparent that exercise has many health benefits. Yet, many people do not add exercise to their daily routines. Although some may add exercise sporadically, such as an infrequent weekend tennis game, regular periodic exercise is generally neglected. Various reasons for this apparent apathy exist. One reason may be that people are simply too busy keeping up with demands of their jobs and their personal lives. Another reason may be that access to exercise facilities is somewhat limited. In particular, the ability to exercise with weight resistance may require exercise machines, and the use of these machines may require membership in a health club. Many people who exercise with weights prefer "free weights" over exercise machines for weight training. Free weights, also known as barbells, require room for using and storing the free weights. Health clubs may provide both free weights and machines. Unfortunately, health clubs Usually require significant membership dues.

Home exercising equipment has become popular for people who do not have time or money to go to health clubs. One advantage of home equipment is the convenience of being able to exercise at home. Another advantage is the lack of membership costs of a health club. However, some of the cost savings is offset by the cost of the equipment. Home exercise machines, which can be used for weight training, typically require expensive initial investments. Additionally, such machines also take up a significant amount of space. Often, people devote an entire room or large portions of a garage to one or more machines for weight training. Unfortunately, many people simply do not have the luxury of having space available for home gyms. Also, it is difficult to obtain an aerobic workout by using weight training equipment. Thus, home exercise enthusiasts must invest in separate aerobic exercise equipment if they want a balanced exercise program. Such equipment might include, for example, stationary exercise bicycles, simulated skiing machines, and treadmills. A disadvantage of home aerobic exercise equipment is the high investment cost and the large amount of space needed for such equipment.

Even when one has invested the money and space needed for home exercise equipment, the advantages of ownership can only be gained when the owner is home. Obviously, large non-portable equipment is impractical to use when one is traveling. Thus, equipment which is portable, yet which can be used for weight training and aerobic exercise, would provide a significant advantage to the owner of such equipment. An additional advantage of such equipment is that people might be more inclined to exercise if they could take their exercise equipment to a pleasant outdoor environment, such as a beach or a park. Unfortunately, it is impractical, and almost impossible, to transport large weight or aerobic exercise equipment to such a location. Thus, there is a need for exercise equipment which gives one the ability to combine weight training and aerobic exercise routines, yet which has properties allowing it to be easily transported. It would be a further advantage if such equipment could be provided at a low cost.

SUMMARY OF THE INVENTION

It is therefore an object of the present invention to provide a low cost apparatus which can be used for weight training and aerobic conditioning.

It is another object of the present invention to provide such an apparatus having the additional properties of portability and being easy to store when not in use.

It is yet another objective of the present invention to provide such an apparatus which requires a small amount of room to use.

In accordance with the foregoing objectives, a flexible barbell exercise apparatus is disclosed. The flexible barbell exercise apparatus comprises a flexible tube with first and second weight receiving vessels attached to opposite ends. The tube has flexible properties; however, it may be reconfigured to become stiff by adding an elongated rigid bar. The elongated rigid bar is sized to removably fit concentrically within a central bore of the tube, in order to substantially eliminate the flexibility of the tube. Owing to the flexible nature of the tube, when the rigid bar is not installed, the apparatus may easily be folded for storage or travel. Also, the flexible properties allow a user to perform aerobic exercises not normally available with barbells. Such exercises may easily be performed by the user, because straps may be attached to the ends of the weight receiving vessels to secure the exercise apparatus to the feet of the human user. Upon installing the rigid bar, within the central bore of the tube, the apparatus may be used in conventional weight training exercises. Conveniently, weights may be removed from the weight receiving vessels to adapt the apparatus for ease of travel.

BRIEF DESCRIPTION OF THE DRAWING

The objects, advantages and features of the present invention will be more clearly understood by reference to the following detailed disclosure and the accompanying drawing in which.

DETAILED DESCRIPTION OF THE PREFERRED EMBODIMENT

Figure 1:
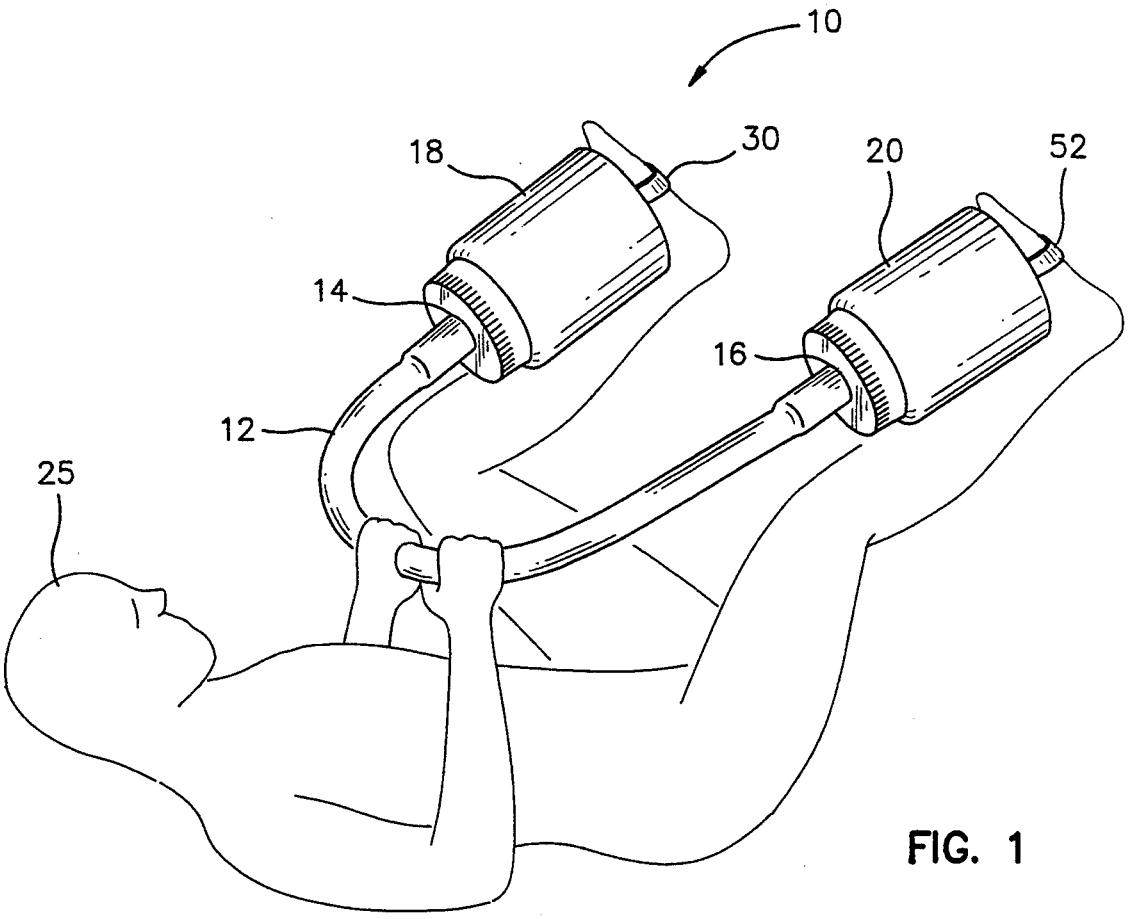
FIG. 1 is a perspective view of a preferred embodiment of the present invention showing a user exploiting the flexible properties of the present invention to engage in aerobic conditioning.
Figure 2:
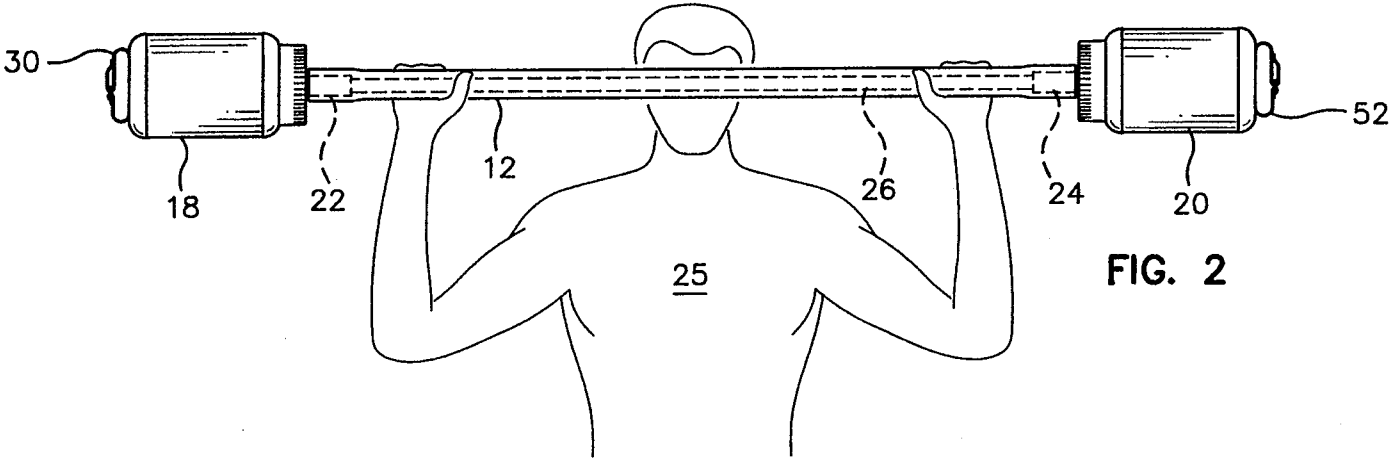
FIG. 2 is a side view of the present invention with an elongated rigid bar installed in the tube and being flexed by a user for weight training exercise.
Figure 3:
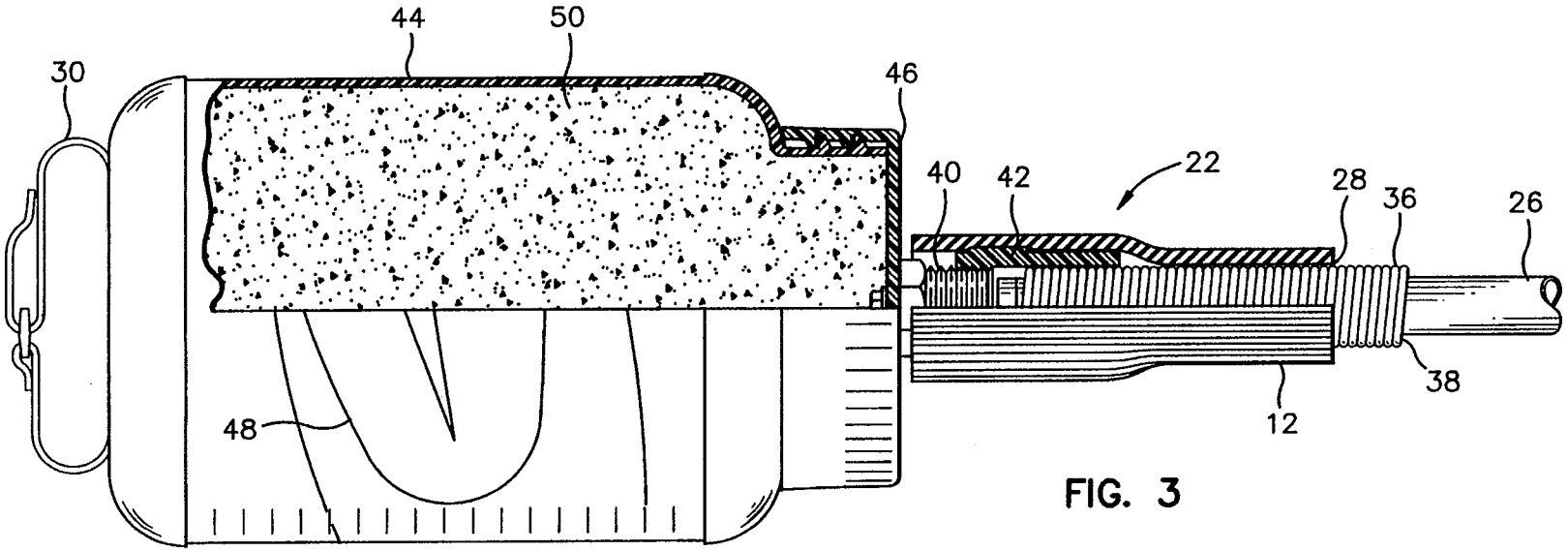
FIG. 3 is an enlarged cutaway side view of the present invention, in a preferred embodiment showing a weight receiving vessel with weight bearing material and also the vessel connecting mechanism.

Referring to FIGS. 1, 2 and 3, a preferred embodiment of the present invention is illustrated. A flexible barbell exercise apparatus 10 is comprised of an elongate flexible tube 12 having a first end 14 and a second opposite end 16. Attached, at opposite ends of the elongate flexible tube 12, are a first weight receiving vessel 18 and a second weight receiving vessel 20. Connecting means 22 (FIG. 3) serve to connect the first weight receiving vessel 18 to a first end of the flexible tube 14. Connecting means 24 for the second weight receiving vessel serve to connect the second weight receiving vessel 20 to the second end 16 of the tube. Either weight receiving vessel may be filled with any weight bearing material which is convenient to a user 25. An example of such a substance may be water or sand. Weight bearing material 50 is shown, for example, as being sand in FIG. 3.

Figure 4:
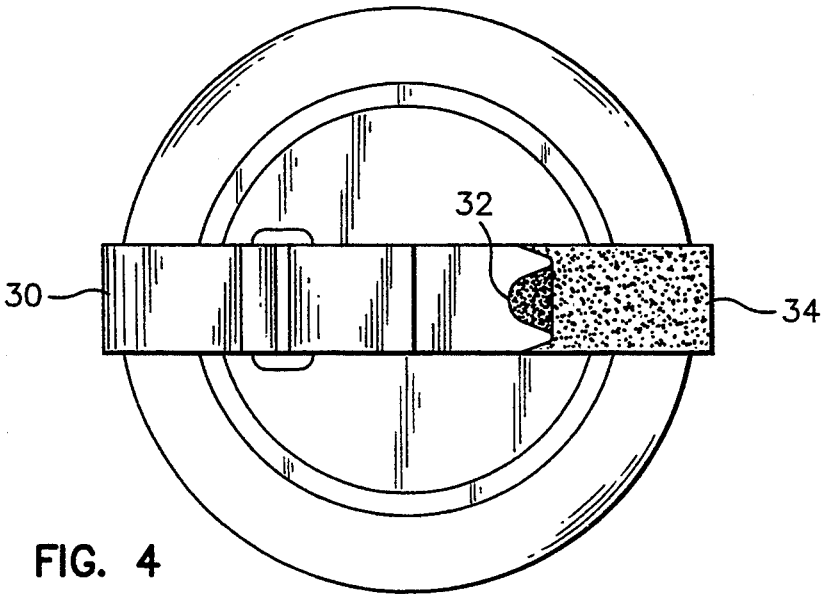
FIG. 4 is an enlarged side view of a strap attached to an end of a weight receiving vessel, which can be used to secure the weight receiving vessel to a human user's foot.

A first strap 30 (FIGS. 2–4) serves to secure a user's foot to the flexible barbell exercise apparatus 10, as best seen in FIG. 1. The strap 30 is connected to the first weight receiving vessel 18. In a similar fashion, a second strap 52, shown in FIG. 3, is connected to the second weight receiving vessel 20. By using the straps to secure the apparatus to the body, a user may use the flexible barbell exercise apparatus 10 for aerobic exercise, such as a bicycle peddling exercise illustrated in FIG. 1. The strap 30 includes a mating pair of fabric hook material segments 32 and corresponding eye-type fastener material segments 34 (FIG. 4). Although many types of materials may be used for securing a user's foot, the preferred embodiment of hook and eye material segments provides a convenient low cost method of doing so. Similarly, the strap 30 may be attached to either of the weight receiving vessels at any point; however, the preferred attachment location for strap 30 is at the outer end because of the convenience for a user. The user could lie on his or her back, with the tube 12 underneath the neck. The hands could then be placed in the straps 30 and 52 to raise the vessels 18 and 20.

Connecting means 22 and connecting means 24 are preferably identical and are symmetrically arranged, as shown in FIG. 2. FIG. 3 shows an exploded cutaway view of connecting means 22. Connecting means 22 includes a coiled spring member 36. The spring member 36 has a hollow interior portion 38 for receiving a corresponding end of an elongate rigid bar 26. Spring member 36 is sized to fit inside a central bore 28 of elongate flexible tube 12. Spring member 36 serves to provide increased resilience to the tube. Connecting means 22 further includes a threaded bolt member 40 attached to the first weight receiving vessel. Threaded collar member 42 is positioned inside the tube at a corresponding end of the tube. Collar member 42 surrounds a corresponding end of the spring member 36. The threaded collar member 42 is screwed onto the threaded bolt member 40.

The rigid bar 26 is sized to removably fit concentrically within a central bore 28 of the flexible tube 12. The rigid bar 26 substantially eliminates the flexibility of tube 12. Thus, as shown in FIG. 2, exercise apparatus 10 may be used to perform conventional barbell exercises with rigid bar 26 in place. It should be apparent that the exercise apparatus 10, in the preferred embodiment of the present invention, can be easily configured for either aerobic or weight training exercises, by respectively adding or removing the rigid bar 26.

Preferably, each weight receiving vessel includes a hollow cylinder 44 having an opening 46 for receiving a quantity of weight bearing material 50. Thus, a user may vary the resistance of exercise apparatus 10 by varying the amount or density of the weight bearing material. In a preferred embodiment, a user may use sand as weight bearing material 50. However, a user may choose other weight bearing materials, such as water. By removing weight bearing material 50, the exercise apparatus 10 may be easily folded after removing rigid bar 26. In such a fashion, exercise apparatus 10 may be easily transported or stored. People who exercise regularly may seek to gain a more attractive physical appearance, as well as for health benefits. Such individuals may also place considerable importance on the aesthetics of their personal exercise equipment. Thus, in a preferred embodiment, each weight receiving vessel may have an outside surface bearing indicia, for example indicia 48, in the form of a cosmetic design. Thus, the aesthetic appeal of exercise apparatus 12 may appeal to a user and thereby increase their enthusiasm to use exercise apparatus 10.

In a preferred embodiment, the exercise apparatus 10 may be manufactured of low cost materials, including rubber, plastic and steel. The flexible tube 12, in a preferred embodiment, is composed of an elastomeric foam material. Each weight receiving vessel is preferably composed of a low cost plastic material capable of supporting weight. Each coiled spring member is preferably composed of steel. Threaded bolt member 40 may be composed of any high-strength material including metal or plastic. Similarly, threaded collar member 42 may be composed of any high-strength material such as plastic or metal.

A preferred embodiment of the flexible barbell exercise apparatus has been shown; however, it should be understood that modifications and adaptions thereof may occur to a person skilled in the art. Therefore, the protection afforded the claimed invention should only be limited in accordance within the scope of the following claims.

What is claimed is:

1. A flexible bar bell exercise apparatus, comprising:

an elongate resilient flexible elastomeric tube having first and second opposite ends;

a first weight receiving vessel;

a second weight receiving vessel;

means for connecting the first weight receiving vessel to the first end of the tube;

means for connecting the second weight receiving vessel to the second end of the tube; and an elongate rigid bar having first and second opposite ends and sized to removably fit concentrically within a central bore of the tube to substantially eliminate the flexibility of the tube.

2. The flexible bar bell exercise apparatus according to claim 1, and further comprising:

a first strap and a second strap, each of the straps attached respectively to one of the first and second weight receiving vessels for securing the exercise apparatus to a corresponding foot or hand of a human user.

3. The flexible bar bell exercise apparatus according to claim 2, wherein each of the straps includes a mating pair of fabric hook and eye type fastener material segments.

4. The flexible bar bell exercise apparatus according to claim 1, wherein the connecting means includes:

a first coiled spring member and a second coiled spring member, each spring member having a hollow interior portion for receiving a corresponding end of the rigid bar member, and each spring member being sized to fit inside the bore of the tube at either end of the tube to provide increased resilience to the tube.

5. The flexible bar bell exercise apparatus according to claim 4, wherein the connecting means further includes:

a first threaded bolt member and a second threaded bolt member, the bolt members being attached to the first and second weight receiving vessels respectively; and first and second threaded collar members, each collar member being positioned inside the tube at a corresponding end thereof and surrounding a corresponding one of the first and second spring members respectively, and screwed onto each of the first and second threaded bolt members respectively.

6. The flexible bar bell exercise apparatus according to claim 1, wherein each weight receiving vessel includes a hollow cylinder having an opening for receiving a quantity of weights.

7. The flexible bar bell exercise apparatus according to claim 1, wherein each weight receiving vessel has an outside surface bearing indicia in the form of a cosmetic design.

8. A flexible bar bell exercise apparatus comprising:

an elongate resilient flexible elastomeric tube having first and second opposite ends;

a first weight receiving vessel;

a second weight receiving vessel;

means for connecting the first weight receiving vessel to the first end of the tube;

means for connecting the second weight receiving vessel to the second end of the tube;

an elongate rigid bar having first and second opposite ends and sized to removably fit concentrically within a central bore of the tube to substantially eliminate the flexibility of the tube; and a first strap and a second strap, each of the straps attached respectively to one of the first and second weight receiving vessels for securing the exercise apparatus to a corresponding foot or hand of a human user.

9. The flexible bar bell exercise apparatus according to claim 8, wherein each of the straps includes a mating pair of fabric hook and eye type fastener material segments.

10. The flexible bar bell exercise apparatus according to claim 8, wherein the connecting means includes:

a first coiled spring member and a second coiled spring member, each spring member having a hollow interior portion for receiving a corresponding end of the rigid bar member, and each spring member being sized to fit inside the bore of the tube at either end of the tube to provide increased resilience to the tube.

11. The flexible bar bell exercise apparatus according to claim 10, wherein the connecting means further includes:

a first threaded bolt member and a second threaded bolt member, the bolt members being attached to the first and second weight receiving vessels respectively; and first and second threaded collar members, each collar member being positioned inside the tube at a corresponding end thereof and surrounding a corresponding one of the first and second spring members respectively, and screwed onto each of the first and second threaded bolt members respectively.

12. The flexible bar bell exercise apparatus according to claim 8, wherein each weight receiving vessel includes a hollow cylinder having an opening for receiving a quantity of weights.

13. The flexible bar bell exercise apparatus according to claim 8, wherein each weight receiving vessel has an outside surface bearing indicia in the form of a cosmetic design.

14. A flexible bar bell exercise apparatus comprising:

an elongate resilient flexible elastomeric tube having first and second opposite ends;

a first weight receiving vessel;

a second weight receiving vessel;

means for connecting the first weight receiving vessel to the first end of the tube;

means for connecting the second weight receiving vessel to the second end of the tube;

an elongate rigid bar having first and second opposite ends and sized to removably fit concentrically within a central bore of the tube to substantially eliminate the flexibility of the tube;

a first strap and a second strap, each of the straps attached respectively to one of the first and second weight receiving vessels for securing the exercise apparatus to a corresponding foot or hand of a human user; and the connecting means including:

a first coiled spring member and a second coiled spring member, each spring member having a hollow interior portion for receiving a corresponding end of the rigid bar member, and each spring member being sized to fit inside the bore of the tube at either end of the tube to provide increased resilience to the tube;

a first threaded bolt member and a second threaded bolt member, the bolt members being attached to the first and second weight receiving vessels respectively; and a first and a second threaded collar member, each collar member being positioned inside the tube and surrounding an end of each of the first and second spring members respectively.

15. The flexible bar bell exercise apparatus according to claim 14, wherein each of the straps includes a mating pair of fabric hook and eye type fastener material segments.

16. The flexible bar bell exercise apparatus according to claim 14, wherein each weight receiving vessel includes a hollow cylinder having an opening for receiving a quantity of weights.

17. The flexible bar bell exercise apparatus according to claim 14, wherein each weight receiving vessel has an outside surface bearing indicia in the form of a cosmetic design.

* * * * *